United States Patent [19]

Reser

[11] 4,195,829

[45] Apr. 1, 1980

[54] SURGICAL TABLE HYDRAULIC SYSTEM

[75] Inventor: G. Louis Reser, Cincinnati, Ohio

[73] Assignee: Sybron Corporation, Rochester, N.Y.

[21] Appl. No.: 898,694

[22] Filed: Apr. 21, 1978

[51] Int. Cl.[2] ..... A61G 13/00

[52] U.S. Cl. ..... 269/325

[58] Field of Search ..... 269/322-328; 5/60-69; 91/520

[56] References Cited

U.S. PATENT DOCUMENTS

| | | | |
|---|---|---|---|
| 3,206,188 | 9/1965 | Douglass . | |
| 3,302,022 | 1/1967 | Brenner et al. . | |
| 3,411,766 | 11/1968 | Lanigan . | |
| 3,680,878 | 8/1972 | Beck . | |
| 3,713,296 | 1/1973 | Black | 91/520 |
| 3,724,003 | 4/1973 | Ellwanger et al. . | |
| 3,868,103 | 2/1975 | Pageot et al. . | |
| 3,900,906 | 8/1975 | Berthelsen . | |
| 3,977,664 | 8/1976 | Mitchell et al. . | |
| 3,982,741 | 9/1976 | Mitchell et al. . | |

*Primary Examiner*—Robert C. Watson

*Attorney, Agent, or Firm*—Theodore B. Roessel; James A. Rich

[57] ABSTRACT

The disclosed surgical table hydraulic system uses a plurality of double acting hydraulic motors, such as double-ended hydraulic cylinders or reversible rotary hydraulic motors, that can be operated either independently or in synchronization. Each of the motors can be connected to a source of pressurized hydraulic fluid, and to a reservoir, for independent action. At least some of the motors can also be connected in a hydraulic series between the hydraulic fluid supply and the reservoir for synchronous operation. In this way, separate elements of the table, controlled by the individual hydraulic motors, can be moved in unison. Also, by operating two motors that control different types of motion, such as elevation of a table and tilting about a horizontal axis, compound motions of one or more sections of the table can be provided.

12 Claims, 9 Drawing Figures

SURGICAL TABLE HYDRAULIC SYSTEM

BACKGROUND OF THE INVENTION

This invention relates to surgical tables, and more particularly to novel hydraulic systems for adjusting these tables to different positions.

Most modern surgical tables can be adjusted in a variety of ways to suit the requirements of different operating techniques. Typical adjustments include vertical, flex, longitudinal tilt and lateral tilt adjustments. In certain cases, it is desirable to provide compound motions of the table, i.e., to move one or more sections in different ways at the same time. For example, in certain urological surgical procedures, it may be desirable to move the table from what is generally referred to as the Trendelburg position, in which the head end of the table is lower than the foot end, to the reverse Trendelburg position, in which the head end is elevated. Preferably the foot end of the table is held at substantially the same elevation. Some urological tables accomplish this by raising or lowering the table and tilting it longitudinally about a central pivot at the same time. A table with this type of adjustment is disclosed in U.S. Pat. No. 3,302,022 to O. R. Brenner and G. L. Reser. One rotary hydraulic motor raises and lowers the table and another motor tilts it. Each of the motors is driven by a separate pump and a separate electric motor, which increases the cost and complexity of the system somewhat.

Some prior art surgical tables, such as the one disclosed in U.S. Pat. No. 3,206,188 to Douglass, drive more than one movable element simultaneously with one pump by using flow dividers to syncronize different hydraulic cylinders. This eliminates the need for multiple pumps, but the flow dividers waste pressure, which makes the pump work harder. Also, since the flow is split between several cylinders, each cylinder moves at a fraction of the speed attained when the cylinder is driven by itself.

SUMMARY OF THE INVENTION

One object of this invention is to provide a surgical table with movable elements that can be operated either individually or simultaneously with a single pump, without using flow dividers.

This is accomplished by connecting movable elements of the table to double acting hydraulic motors, such as double acting hydraulic cylinders or reversible rotary hyraulic motors, that can be operated either independently or in synchronization. Each of the motors can be connected to a supply of pressurized hydraulic fluid and to a hydraulic fluid reservoir for independent operation. Also, at least some of the motors in the system can be connected in a hydraulic series between the fluid supply and the reservoir. In this mode, fluid discharged from a first motor is fed to the second motor. Thus, the motors and the elements which they control move at the same time and at a coordinated rate.

Another object of the invention is to provide a surgical table that can be raised or lowered and pivoted about a horizontal axis (tilted) at the same time. A table support is raised or lowered by a first double acting hydraulic motor. At least one table section, mounted on the support, is pivoted about a horizontal axis by a second double acting hydraulic motor. The two motors are connected in hydraulic series, as described above, so that they operate together to raise or lower and tilt the table simultaneously.

Yet another object of the invention is to provide a novel hydraulic control system for combinations of motions such as those described above. According to the invention, the inlet to a first valve and the inlet to the second valve are connected in parallel to a source of pressurized hydraulic fluid such as a pump. The outlet from the first valve is connected to one side of a first double acting hydraulic motor and to an inlet to the third valve. The outlet from the second valve is connected to the other side of the first hydraulic motor and to the inlet to a fourth valve. The outlets from both the third valve and the fourth valve are connected to the inlets to a fifth and a sixth valve. This cross-over connection permits either end of the first hydraulic motor to be connected to either end of another hydraulic motor in the series, and lets fluid bypassing the first motor through valves two and four reach either end of another motor.

The outlets from the fifth and sixth valves are connected respectively to the two sides of a second double acting hydraulic motor and to the inlets of a seventh and eighth valve. The outlets from these valves can be connected directly to a reservoir for the hydraulic fluid, or to valves for another double acting motor.

With this arrangement, either the first or second hydraulic motor (or any other hydraulic motor in the series) can be operated independently, bypassing the other motors. Also, two or more motors can be connected in a hydraulic series and operated simultaneously at a coordinated speed without reducing the speed of any of the motors.

Other objects and advantages of this invention will be apparent from the following description.

DRAWINGS

DETAILED DESCRIPTION

Figure 1:
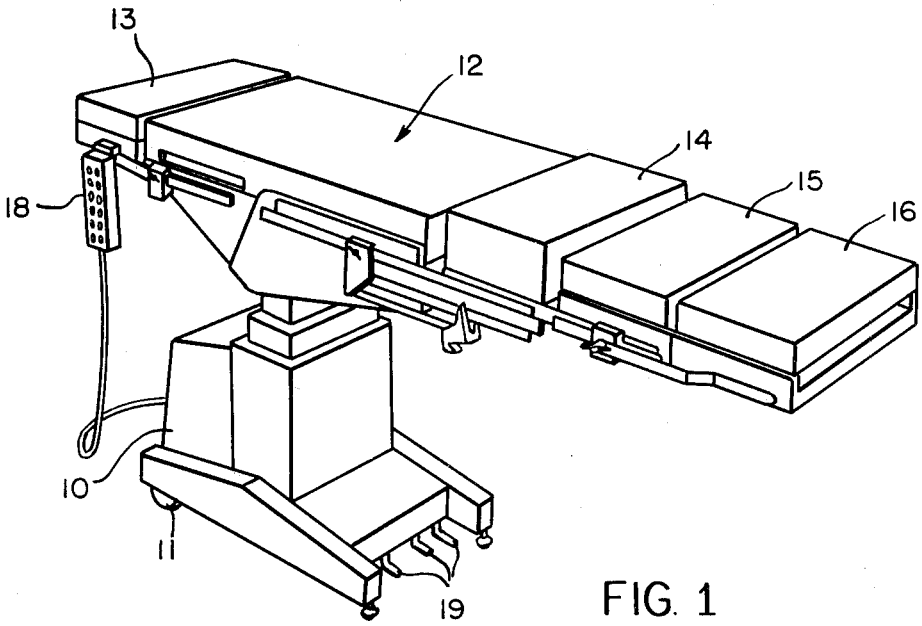
FIG. 1 is a perspective view of a surgical table embodying this invention.

The surgical table illustrated in FIGS. 1–5 can be used for a wide variety of both urological surgical procedures and general surgical procedures. The table assembly is mounted on a mobile base 10 with casters 11. The central portion of the table 12, described in more detail below, can be adjusted hydraulically to a variety of positions. Various attachments, including a head rest 13, leg rest 14, leg extension 15 and step or knee rest 16, can also be removed or repositioned manually to adapt the table to various surgical requirements.

Figure 2:
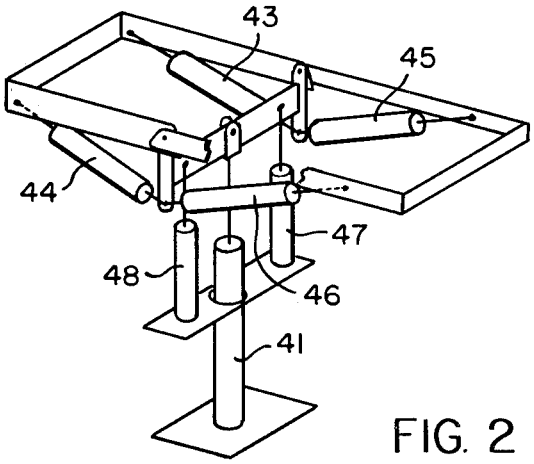
FIG. 2 is a perspective schematic view, from the same viewpoint as FIG. 1, showing hydraulic cylinders for adjusting certain elements of the table.
Figure 3:
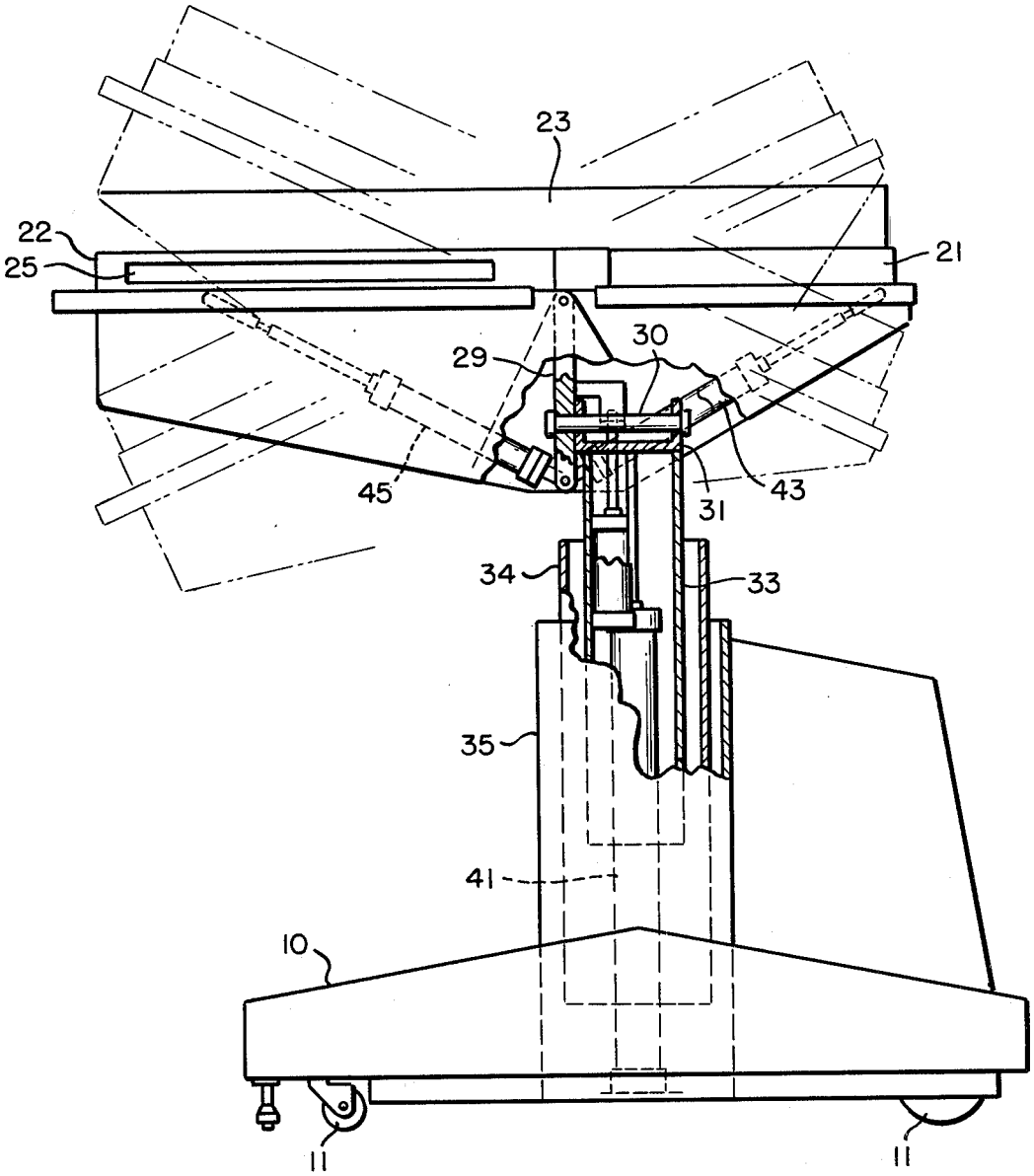
FIG. 3 is a side view of the central portion of this table, partially broken away to illustrate certain structural details.
Figure 4:
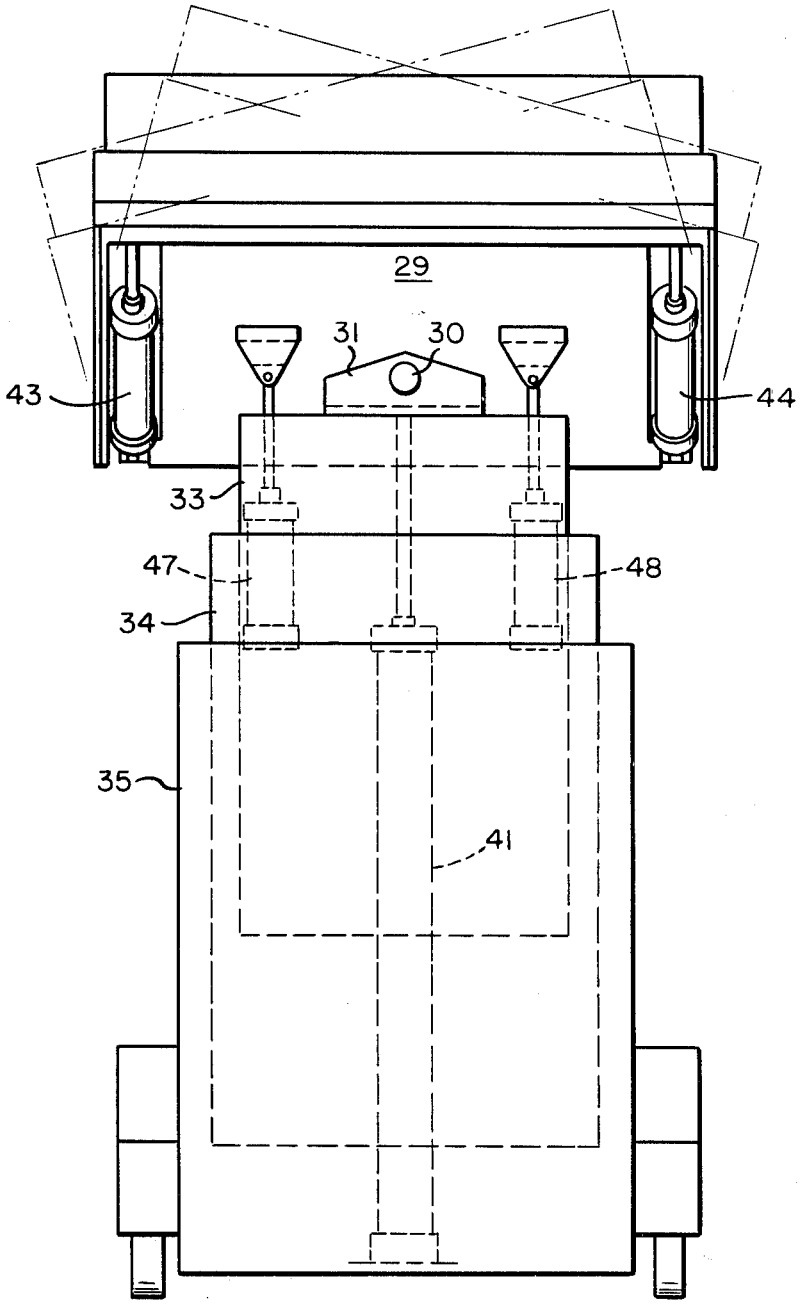
FIG. 4 is an end view of the central portion of the table.

The hydraulic cylinders that adjust the central portion of the table are shown schematically in FIG. 2, and in somewhat more detail in FIGS. 3 and 4. These cylinders can be operated by a portable hand control 18, which is preferably located at the head end of the table where it is readily accessible to the anesthesiologist during general surgery. Some of the controls can also be operated by foot pedals 19, located so as to be accessible to a surgeon located at the foot end of the table in urological surgery. Preferably, these pedals allow the surgeon to raise or lower the table, or tilt it to the Trendelburg or reverse Trendelburg positions.

As may be seen in FIG. 3, the central section of the table includes a back or thoracic section 21 and a lumbar or pelvic section 22, both of which are covered by a common pad 23. All of these, as well as the various attachments described above, are constructed of radiolucent material. Also, insofar as is possible, structural elements are located at the sides of these elements to keep the center of table open and facilitate radiological procedures.

The side of the pelvic section 22 contains a slot 25 for a 14" by 17" x-ray film cassette. A stationary grid cabinet is detachably mounted above the slot. The table can also be used with image intensification equipment by removing the grid cabinet and positioning the intensifier in the open space beneath the pelvic section. Smaller cassettes can be inserted into the back section 21 or into the various attachments described above. The table can also be used for radiological examinations of other areas of the body by repositioning the patient and/or modifying the arrangement of the table. For example, the head rest 13 can be attached to the foot end of the table and the leg rest 14, leg extension 15 and knee rest 16 can be attached to the head end, so that the patient can be positioned over the pelvic section 22 for chest x-rays.

The back section 21 and pelvic section 22 are pivotally connected to a yoke 29 mounted at the top of the inner section 33 of a three section telescoping pedestal on base 10. The yoke 29 is attached to a frame 31 on the top of section 33 by a pivot pin 30 that allows the yoke to pivot laterally (about the longitudinal axis of the table) to place the table in the various positions shown in phantom in FIG. 4.

The table is adjusted vertically with a double acting cylinder 41 that drives the top section 33 of the telescoping pedestal. The top section 33 is guided by rollers and guide bars (not shown) attached to the middle section 34 of the pedestal, and the middle section in turn is guided by rollers and guide bars on the fixed, lower section 35.

Head end angulation of the table is provided by two double acting hydraulic cylinders 43, 44 attached to the yoke assembly 29 and to the back section 21 of the table. One of these cylinders is located at either side of this section, as shown in FIGS. 2 and 4, to keep the middle of this section open for radiological applications. Preferably, cylinders 43, 44 can pivot the back section 21, and any attachments mounted on it, approximately 25° above or 25° below the horizontal position.

Foot end angulation of the table is provided by a similar pair of cylinders 45, 46 connected to the yoke 29 and to the pelvic section 22 of the table.

Lateral tilting of the table is controlled by two hydraulic cylinders 47, 48 mounted on the top section of the telescoping pedestal, with their rods connected to the yoke 29. These cylinders are not connected hydraulically to the other cylinders in the system. Thus, single acting cylinders can be used instead of the double acting cylinders used for the other functions of the system.

Figure 5:
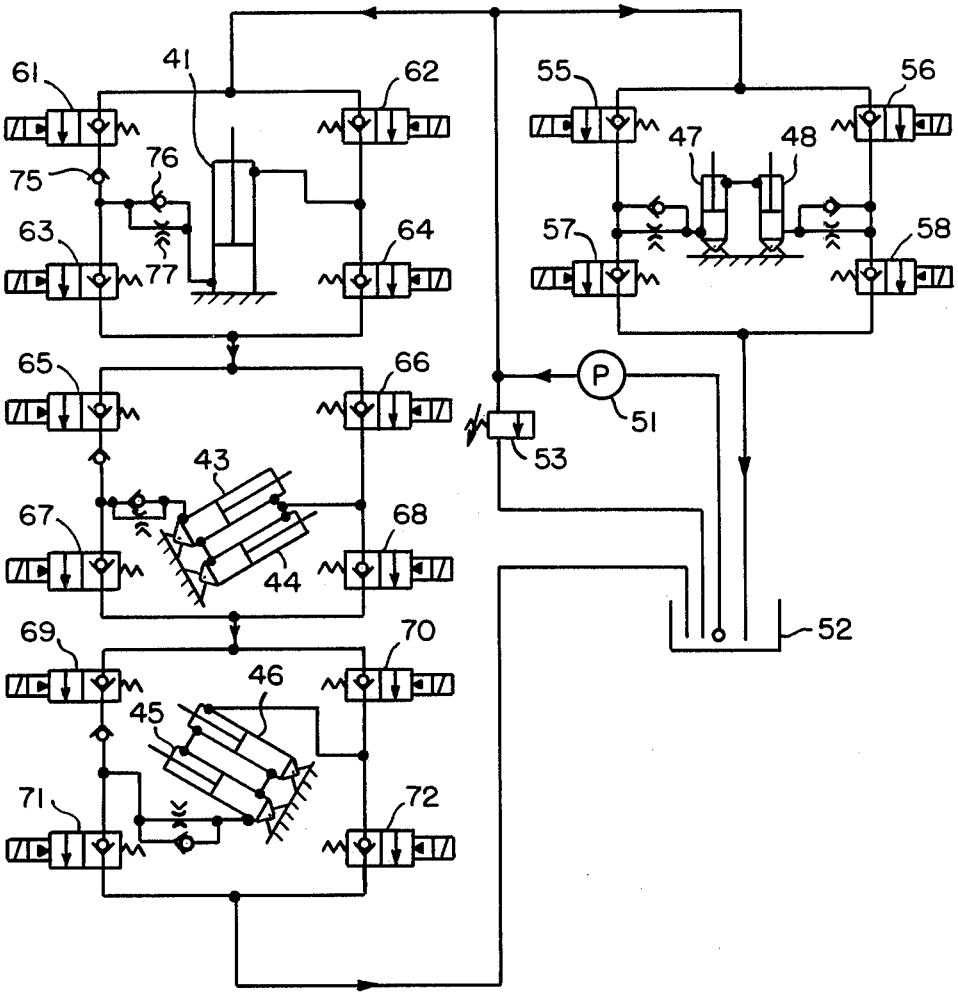
FIG. 5 is a schematic of the hydraulic system which controls the cylinders illustrated in FIGS. 2–4.

FIG. 5 illustrates the hydraulic control system for the system discussed above. Hydraulic fluid is supplied by a pump 51 from a reservoir 52. Preferably, the pump supplies hydraulic fluid at a rate of about ¼ gal/min. (1 liter/min) and a pressure of about 800 psi (5.5 N/mm$^2$). A relief valve 53 is connected to the pressure side of the pump so that the pump can continue to run when controls are being operated intermittently, and to limit pressure and bypass fluid when cylinders are run to the ends of their travel.

Fluid from the pump is supplied to the inlets of two solenoid operated poppet valves 61 and 62. The outlet from valve 61 is connected to a port at the base end of the elevation cylinder 41, which raises and lowers the table, and to the inlet of valve 63. The outlet from valve 62 is connected to a port at the rod end of the elevation cylinder 41 and to the inlet of valve 64. The outlets from valves 63 and 64 are interconnected with the inlets of valves 65 and 66. These valves supply fluid to the base end and the rod end of cylinders 43 and 44, which pivot the head end of the table. Since these cylinders are connected mechanically by the table structure and operate simultaneously, they are mounted in parallel in the hydraulic system.

Fluid discharged from or bypassing the head end cylinders 43 and 44 passes through either valve 67 or valve 68, both of which are connected to the inlet of valve 69 and 70, which are connected respectively to the base and rod ends of cylinders 45 and 46, which drive the foot end of the table. Fluid discharged from or bypassing these cylinders flows through valve 71 or 72 back to the reservoir 52.

This arrangement allows either the elevation cylinder 41, the head end cylinders 43 and 44, or the foot end cylinders 45 and 46 to be operated independently while the other cylinders are bypassed. For example, cylinders 43 and 44 can be operated to raise the head end of the table by opening valve 62 and 64, bypassing the elevation cylinder, opening valves 65 and 68 to let fluid flow to the base end of cylinders 43 and 44 and from the rod ends of these cylinders, and opening valves 70 and 72 to bypass cylinders 45 and 46. (All other valves remain closed). This pivots the head end of the table to the upper phantom position illustrated in FIG. 3.

Cylinders are bypassed by opening the valves at the unloaded rod ends of the cylinders (valves 62 and 64 for the elevation cylinder and valves 70 and 72 for the foot end cylinders) so that the cylinders will not drift. If valves on the loaded base ends were opened instead, the load exerted by the table might force fluid from the base ends of the cylinders, letting the table and/or foot end of the table drift downward. This could be prevented with additional shutoff valves in the connecting lines to the cylinders or, in some cases, with mechanical brakes, but using the rod end valves for bypassing is simplier.

The foot end of the table can be raised simultaneously with the head end by opening valve 69, instead of valve 70, so that the fluid discharged from the rod ends of cylinders 43 and 44 passes through valves 68 and 69 to the base ends of cylinders 45 and 46. This forces the two sets of cylinders to move together and pivot both the back section 21 of the table and the pelvic section 22 towards the upper phantom positions illustrated in FIG. 3. This type of movement is conventional referred to as "break-up" or "flex-up". Similarly, cylinders 43, 44, 45 and 46 can be operated together to break or flex the table down by opening valves 66, 67, 66, 70 and 71.

When the head end and foot end of the table are moved in the same direction in the foregoing manner, they do not move at exactly the same speed or by exactly the same amount because of the difference in volume between the base ends and the rod ends of the cylinder. With typical cylinders, this difference in volume is about 10%. Thus, for every cc of hydraulic fluid supplied to the base ends of cylinders 43 and 44, about 0.9 cc is discharged from the rod ends of these cylinders and fed to the base ends of cylinders 45 and 46. Since the speed at which each section pivots, and the arc through which it pivots, depends upon the volume supplied to the cylinders, the foot end of the table pivots slightly slower than the head end and moves through a slightly smaller arc. (When the two sections are flexed down together, the foot section will move slightly faster and through a slightly greater arc). Since exact positioning of the sections of the table is seldom required, these minor variations have not been found objectionable. Also, these differences can easily be compensated for by operating either the foot or head end individually at the end of a flex cycle.

The head end and foot end cylinders can also be operated in synchronization with the elevation cylinder 41 to pivot the entire table while maintaining the elevation of the foot end relatively constant. As was described above, this type of motion is desirable in urological surgery to move from the horizontal position to the Trendelburg or reverse Trendelburg positions, or from one of these positions to the other.

To move to the Trendelburg position, valves 62, 63, 66, 67, 69 and 72 are opened. The other valves remain closed. This lowers the yoke, lowers the head end of the table with respect to the yoke, and raises the foot end of the table with respect to the yoke. With proper coordination of the mounting geometry of the foot and head end cylinders, the volumes of these cylinders, and the volume of the elevation cylinder, the result of this motion is to pivot the entire table downwardly about the foot end, while the foot end remains at substantially the same elevation. Similarly, by opening valves 61, 64, 65, 68, 70 and 71, the table can be pivoted upwardly about its foot end.

Because of the mounting geometry of the head and foot end cylinders, the back section and pelvic section of the table do not remain in precisely the same plane during this type of motion. In the illustrated embodiment, moving from the extreme Trendelburg position, in which the table is approximately 25° below horizontal, to the horizontal position will tilt these sections approximately 9° with respect to one another. This can be easily compensated for by individual movement of either the foot or head end of the table. However, if the table is pivoted past horizontal to the extreme reverse Trendelburg position, with the head end approximately 25° above horizontal, compensation will not be necessary because the mounting geometry of the cylinders will correct for this difference as the table pivots up from the horizontal position. The back and pelvic sections will once again be in substantially the same plane when the table reaches the end of its travel.

As can be readily seen from FIG. 5, various other combined forms of movement can be achieved with the illustrated system. However, the combined forms of motion described above are believed to be the ones that will most often be required in surgery. Thus, in the preferred embodiment, individual control buttons to activate the necessary combinations of valves for these motions are provided on the portable hand unit 18 for this table.

In effect, the valves described above are arranged in two parallel sets of valves, with hydraulic cylinders and open cross-over lines connected to each set between alternate pairs of valves. This sequence can be easily expanded, by adding valves and cylinders, to control many more elements either individually or in syncronization from a single pump. With the cylinders connected in series as described above, the cylinders must move at a coordinated rate because the pistons of the cylinders are connnected by the hydraulic fluid between them, which is substantially incompressible. Thus, there is no need for flow dividers or other controls to keep the cylinders syncronized. This simplifies the system, and allows different cylinders to actually help each other in some situations. For example, when the table is pivoted down to the Trendelburg position, some of the force exerted on the elevation and head end cylinders by the table is transmitted to and helps drive the foot end cylinders. This reduces the work that must be done by the pump. Furthermore, since the cylinders are connected in series, they move at substantially the same speed in either independent or multiple operation.

As may be seen in FIG. 5, the same pump 51 that supplies the fluid for the elevation and various longitudinal tilting functions also supplies the cylinders 47 and 48 that control the lateral tilt function. Since these cylinders are not operated in synchronization with the cylinders described above, no provisions have been made to connect these cylinders in series with the others. Single acting cylinders can be used for this function because the two cylinders are connected by the yoke. (For example, the table can be tilted to the right, as viewed in FIG. 4, by opening valve 55 to supply hydraulic fluid to the base end of cylinder 47, and opening valve 58 to let fluid from the rod end of cylinder 48 flow back to the reservoir. As the piston in cylinder 47 is forced up by the incoming fluid, the yoke will push the piston in cylinder 48 down and force fluid back to the reservoir). However, it may be preferable to use double acting cylinders, which are not appreciably more expensive, and connect the rod ends together, as shown in FIG. 5, to catch any fluid leaking by the piston seals. In effect, these cylinders act as single acting cylinders.

Preferably, the valves shown in FIG. 5 are all solenoid operated poppet valves installed so that the high pressure fluid enters the valve above the poppet or valve head. Thus, when the valves are closed the poppet acts as a check valve that helps minimize leakage. This type of valve is believed to be superior to a spool valve for this installation.

Since these poppet valves only function as check valves in one direction, conventional check valves 75 are installed in the lines from valves 61, 65 and 69 to the base ends of the cylinders they supply so that the loads on these cylinders will not force fluid back through these valves and allow the cylinders to drift. The line to the base ends of each of these cylinders also contains another check valve 76 and a restricted orifice, preferably a needle valve 77, connected in parallel. When fluid is being supplied to the base end of one of the cylinders it passes through the check valve 76. However, when fluid is flowing out the check valve 76 closes and forces the fluid through the needle valve 77, which controls the rate at which fluid can be discharged from the cylinder. This type of control is used for all of the cylinders in the system, including the lateral tilt cylinders 47 and 48.

Figure 6:
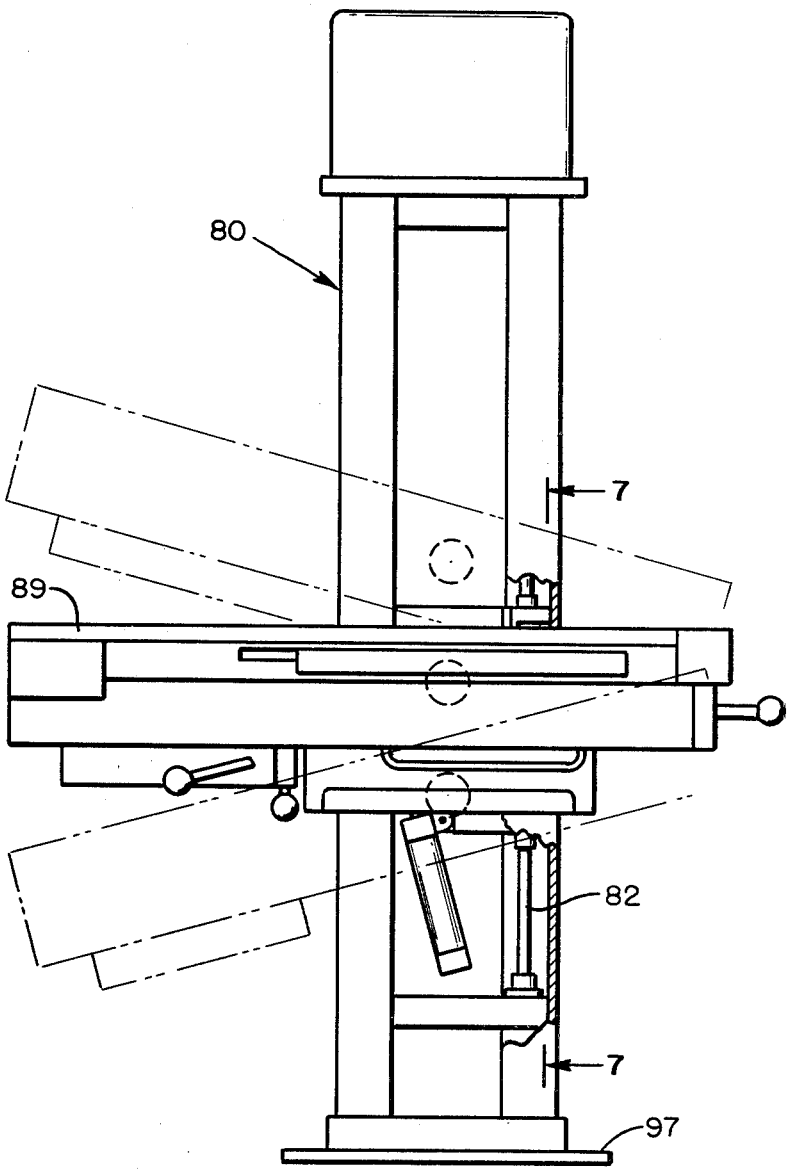
FIG. 6 is a partially sectioned front elevation view of another table embodying this invention.
Figure 7:
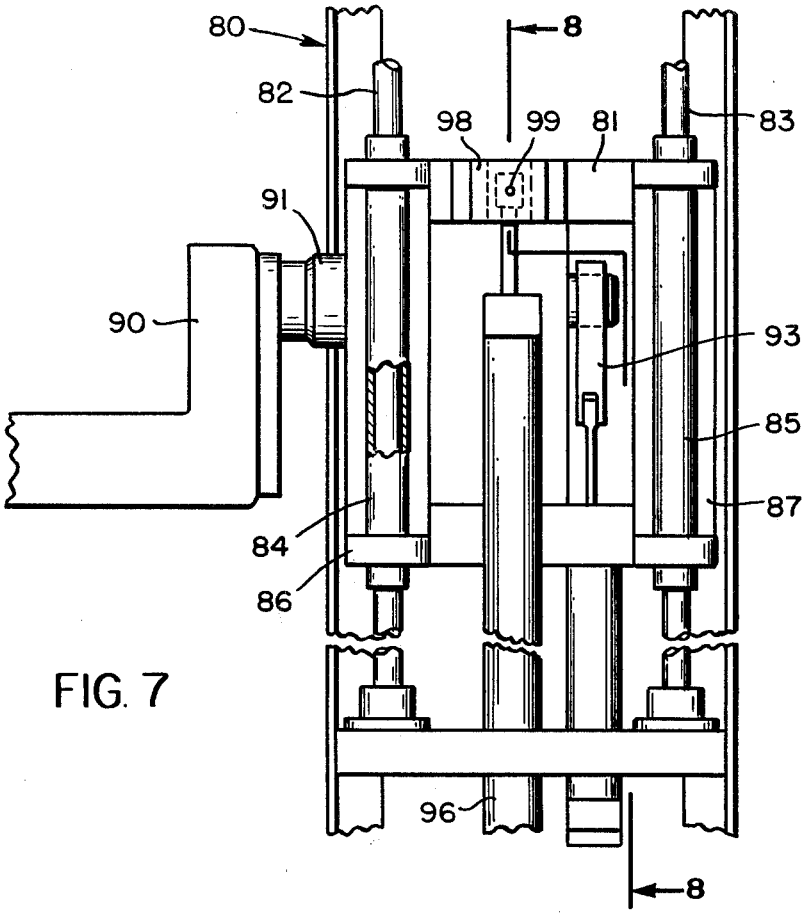
FIG. 7 is a partially sectioned detail view taken along lines 7—7 of FIG. 6, illustrating certain elements which support and move the table illustrated in FIG. 6.
Figure 8:
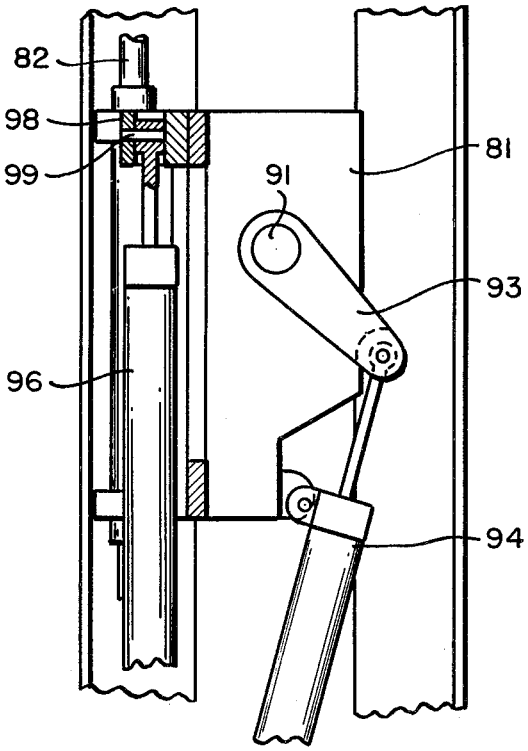
FIG. 8 is a rear elevation detail view along lines 8—8 in FIG. 7.

FIGS. 6–8 illustrate a modification of the table described in U.S. Pat. No. 3,302,022 to O. R. Brenner and G. L. Reser which incorporates this invention. Various structural features of the table are disclosed in more detail in that patent.

The table in this system is supported by a vertical column 80 containing a carriage 81 (shown in FIGS. 7 and 8) which rides on vertical rods 82, 83 within the column. The rods extend through bearings 84, 85, mounted in brackets 86, 87 bolted to the carriage 81. The brackets and bearings can be adjusted to compensate for the tendency of the carriage to cock or tilt slightly under the weight of the table 89 and patient. The table 89 is supported by a yoke 90, best seen in FIG. 7, which has a shaft 91 extending through a bushing in carriage 81. A lever arm 93 is mounted on the rear end of shaft 91, and a hydraulic cylinder 94, mounted on the carriage, with its rod end connected to the lever arm 93, drives the lever arm and thereby tilts the table in the longitudinal direction. The cylinder 94 is mounted on a carriage by a trunion pin (not shown) at the rod end of the cylinder, which allows the base end of the cylinder to pivot as the lever arm moves through its arc.

The carriage is moved up and down with a second hydraulic cylinder 96 mounted on the base plate 97 of the column, between the vertical rods 82, 83. The rod of cylinder 96 is connected to a slotted bracket 98, bolted to carriage 81, by a pin 99 which extends through the bracket and through an eye at the top of the rod. This pin allows the carriage to pivot with respect to the rod if the carriage is cocked slightly by the weight of the table and patient.

Figure 9:
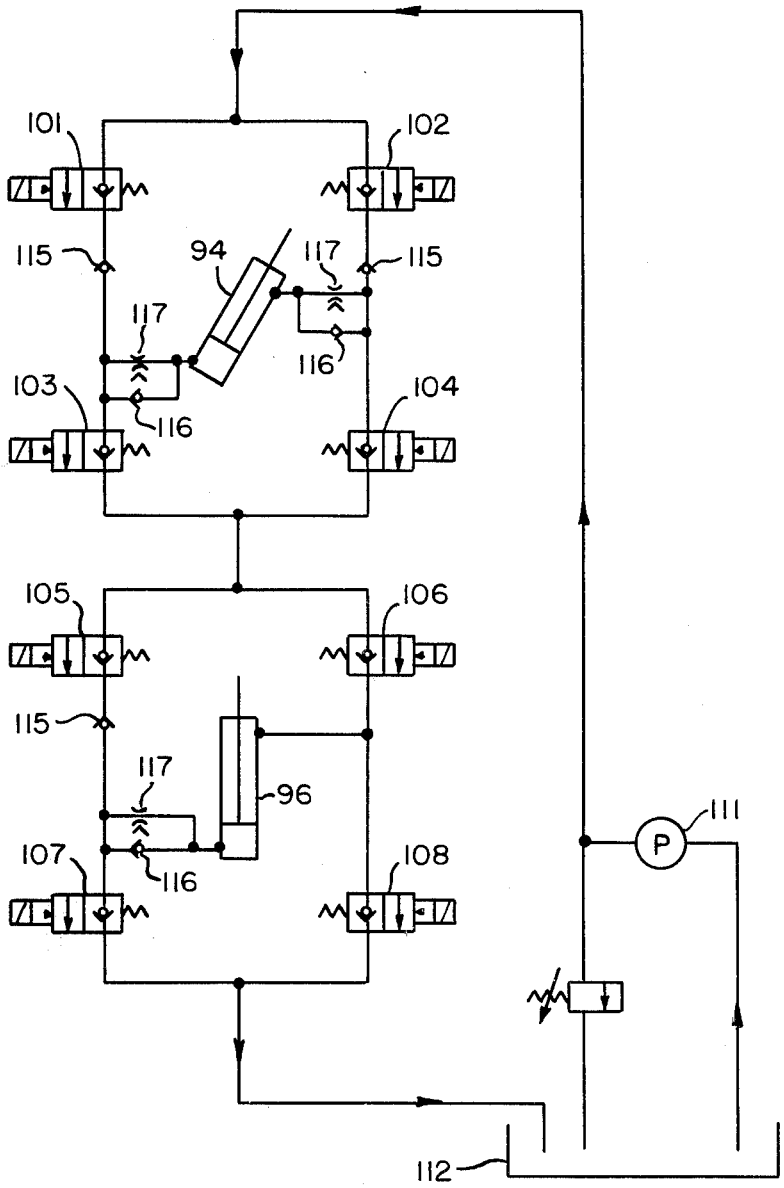
FIG. 9 is a hydraulic schematic for the table illustrated in FIGS. 6–8.

The hydraulic system for this table is shown in FIG. 9. It is much the same as the first two stages of the system illustrated in FIG. 5, except that the tilt cylinder 94 is the first cylinder in a series, and additional check and flow control valves are provided, for purposes explained in more detail below.

As in the system shown in FIG. 5, hydraulic fluid is supplied by a pump 111 from a reservoir 112. The pump is connected to the inlet side of two solenoid operated poppet valves 101, 102, which are connected to opposite sides of the tilt cylinder 94. When valve 101 is opened and appropriate valves are opened downstream to let fluid flow from the rod end of the cylinder back to the reservoir, the cylinder pushes up on lever arm 93 and raises the head end of the table (the left hand side as viewed from the front in FIG. 6). When valve 102 and the appropriate downstream valves are opened, the foot end of the table is raised.

The outlet from valve 101 and the base end of cylinder 94 are connected to the inlet of valve 103. The outlet from valve 102 and the rod end of cylinder 94 are connected to valve 104. The outlets from valve 103 and 104 are both connected to the inlets of valves 105 and 106, which supply fluid to the base and rod ends of the elevation cylinder 96 respectively. Fluid discharged from or bypassing cylinder 96 flows through valves 107 or 108 back to the reservoir 112.

Check valves 115 are installed downstream from valves 101, 102 and 105 to prevent drift of the hydraulic cylinders, and additional check valves 116 and needle valves 117 control the rate at which fluid is discharged from the base end of either cylinder, or the rod end of the tilt cylinder 94. In this installation, the table can exerted a load on the tilt cylinder in either direction. Thus, the check valves 115 116 and needle valves 117 are provided on both sides of this cylinder.

With the table shown in FIGS. 6–8, the loads that might be exerted on the foot end of table 86 in typical operating procedures tend to be somewhat higher than the loads that might be exerted on the head end. Thus, the pressures which might be generated in the rod end of cylinder 94 tend to be somewhat higher than the pressures that might be generated in the base end of the cylinder by loads on the table. As a result, I prefer to bypass the tilt cylinder by opening valves 101 and 103 instead of valves 102 and 104. Under typical conditions, when the elevation cylinder is run individually the pressure required to raise or lower the elevation cylinder keeps the pressure at the lightly loaded base end of the tilt cylinder high enough to prevent the cylinder from drifting. This is why the tilt cylinder is placed first in the series.

As in the system shown in FIGS. 1–5, the volumes of the hydraulic cylinders and the various mechanical linkages are coordinated to provide Trendelburg and reverse Trendelburg tilt. Opening valves 102, 103, 106 and 107 lowers the yoke and pivots the yoke to raise the foot end with respect to the yoke, placing the table in the Trendelburg position. Opening valves 101, 104, 105 and 108 raises the yoke and the head of the table to the reverse Trendelburg position. As can be seen from the schematic, the lift and tilt cylinders could also be operated in synchronization to pivot the table about its head end.

Thus, it may be seen that this invention can be used to provide either independent or coordinated motion, in a variety of system, with relatively simple control systems that use a single pump and eliminate flow dividers, which would reduce the speed of each function to a fraction of its independent speed when run simultaneously and increase the power required to operate the system, or other complicated forms of control. Various modifications in the systems disclosed above will be readily apparent to those skilled in the art. For example, one or more hydraulic motors, such as those disclosed in U.S. Pat. No. 3,302,022, could be used in place of the hydraulic cylinders for many functions. These and many more modifications may be made within the scope of this invention, which is defined by the following claims.

I claim:

1. A surgical table comprising:

a first double acting hydraulic motor connected to a vertically movable table support;

a second double acting hydraulic motor connected to a table section mounted on said support and adapted to pivot about a horizontal axis;

means for supplying hydraulic fluid under pressure to said first hydraulic motor or to said second hydraulic motor;

means for connecting either said first hydraulic motor or said second hydraulic motor to a hydraulic fluid reservoir; and means for connecting said first motor and said second motor in series between said fluid supply means and said fluid reservoir.

2. A surgical table comprising:

a first double acting hydraulic motor connected to a table section mounted on a table support and adapted to pivot about a horizontal axis;

a second double acting hydraulic motor connected to a second table section mounted on said support and adapted to pivot about a horizontal axis;

means for supplying hydraulic fluid under pressure to said first hydraulic motor or to said second hydraulic motor;

means for connecting either said first hydraulic motor or said second hydraulic motor to a hydraulic fluid reservoir; and means for connecting said first motor and said second motor in series between said fluid supply means and said fluid reservoir.

3. A surgical table according to claim 2 wherein the first table section and the second table section pivot about the same horizontal axis.

4. A surgical table comprising:

a base;

a table support mounted on said base and adapted for vertical movement;

a table section mounted on said support and adapted to pivot about a horizontal axis;

a first double acting hydraulic motor mounted on said base and adapted to move said support vertically;

a second double acting hydraulic motor adapted to pivot said table about said horizontal axis;

means for supplying hydraulic fluid under pressure to either said first double acting hydraulic motor or to said second double acting hydraulic motor;

means for connecting either said first hydraulic motor or said second hydraulic motor to a hydraulic fluid reservoir;

means for connecting said first motor and said second motor in series between said fluid supply means and said reservoir.

5. A surgical table according to claim 4 wherein said table support comprises a vertically movable yoke, said yoke being adapted to pivot about a longitudinal horizontal axis of the table, and said table section is mounted on said yoke and adapted to pivot about a lateral horizontal axis of said table.

6. A surgical table according to claim 4 or claim 5 wherein said first double acting hydraulic motor comprises a double acting hydraulic cylinder and said second double acting hydraulic motor comprises a double acting hydraulic cylinder mounted on said support.

7. A surgical table according to claim 4 or claim 5 further comprising:

a second table section mounted on said support and adapted to pivot about a horizontal axis;

a third double acting hydraulic cylinder adapted to pivot said second table section about said horizontal axis;

means for supplying hydraulic fluid under pressure directly to said third hydraulic motor and means for connecting the third hydraulic motor directly to said hydraulic fluid reservoir; and means for connecting said first motor, said second motor and said third motor in series between said fluid supply means and said hydraulic fluid reservoir.

8. A surgical table according to claim 7 further comprising means for connecting said second motor and third motor in series between said hydraulic fluid supply means and said hydraulic fluid reservoir.

9. A surgical table according to claim 7 wherein said first, second and third hydraulic motors comprise double acting hydraulic cylinders and said second and third double acting hydraulic cylinders are mounted on said support and connected to said table sections.

10. A surgical table according to claim 4 wherein said table support comprises a yoke having a shaft extending through a vertically moving carriage, with a lever arm extending from said shaft, said second double acting hydraulic cylinder being mounted on said carriage and connected to said lever arm.

11. A surgical table according to claims 4 or 10 wherein said pump supplies fluid to said second motor, said second motor supplies fluid to said first motor, and said first motor is connected to said reservoir when said motors are connected in series.

12. A surgical table according to claim 4 or claim 10 wherein said first and second hydraulic motors comprise double acting hydraulic cylinders.

* * * * *